US010005983B2

(12) United States Patent
Chow et al.

(10) Patent No.: US 10,005,983 B2
(45) Date of Patent: Jun. 26, 2018

(54) CLEANING FORMULATIONS AND METHODS OF USE THEREOF

(71) Applicants: Reuben H Chow, Pleasanton, CA (US); Gary A Konkel, Modesto, CA (US)

(72) Inventors: Reuben H Chow, Pleasanton, CA (US); Gary A Konkel, Modesto, CA (US)

( * ) Notice: Subject to any disclaimer, the term of this patent is extended or adjusted under 35 U.S.C. 154(b) by 577 days.

(21) Appl. No.: 14/621,234

(22) Filed: Feb. 12, 2015

(65) Prior Publication Data

US 2016/0237379 A1 Aug. 18, 2016

(51) Int. Cl.

| | |
|---|---|
| ***C11D 1/62*** | (2006.01) |
| ***C11D 1/72*** | (2006.01) |
| ***C11D 3/43*** | (2006.01) |
| ***C11D 3/50*** | (2006.01) |
| ***C11D 1/10*** | (2006.01) |
| ***C11D 1/722*** | (2006.01) |
| ***C11D 3/16*** | (2006.01) |
| ***C11D 1/02*** | (2006.01) |
| ***C11D 3/20*** | (2006.01) |
| ***C11D 1/83*** | (2006.01) |
| ***C11D 3/37*** | (2006.01) |
| ***C11D 3/382*** | (2006.01) |
| ***C11D 11/00*** | (2006.01) |
| *C11D 1/75* | (2006.01) |

(52) U.S. Cl.

CPC ..... *C11D 1/10* (2013.01); *C11D 1/02* (2013.01); *C11D 1/62* (2013.01); *C11D 1/721* (2013.01); *C11D 1/722* (2013.01); *C11D 1/83* (2013.01); *C11D 3/162* (2013.01); *C11D 3/2041* (2013.01); *C11D 3/373* (2013.01); *C11D 3/3734* (2013.01); *C11D 3/382* (2013.01); *C11D 11/0023* (2013.01); *C11D 11/0035* (2013.01); *C11D 1/72* (2013.01); *C11D 1/75* (2013.01)

(58) Field of Classification Search

CPC .... C11D 1/02; C11D 1/62; C11D 1/72; C11D 1/721; C11D 1/722; C11D 1/75; C11D 1/83; C11D 3/162; C11D 3/2041; C11D 3/2068; C11D 3/30; C11D 3/50; C11D 3/3734; C11D 3/3738

USPC ..... 510/191, 238, 424, 427, 433, 466, 475, 510/499, 504, 505, 506

See application file for complete search history.

(56) References Cited

U.S. PATENT DOCUMENTS

| | | | |
|---|---|---|---|
| 3,123,640 | A | 3/1964 | Longley |
| 3,141,905 | A | 7/1964 | Longley |
| 4,020,016 | A | 4/1977 | Sokol |
| 5,252,245 | A | 10/1993 | Garabedian |
| 5,437,807 | A | 8/1995 | Garabedian |
| 5,454,984 | A | 10/1995 | Graubert |
| 5,468,423 | A | 11/1995 | Garabedian |

*Primary Examiner* — Gregory R Delcotto

(74) *Attorney, Agent, or Firm* — Carmen Pili Ekstrom

(57) ABSTRACT

Cleaning formulations and methods of use thereof are described. Embodiments of the cleaning formulation comprise (a) an effective amount of citrus based compounds and mixtures thereof; (b) an effective amount of a surfactant selected from primary and secondary nonionic surfactants, co-surfactants and mixtures thereof; (c) an effective amount of a wetting agent; (d) an effective amount of an emulsifier; and (e) optimally, an effective amount of an environmental impurity resistance mixture with an effective amount of soy bean, palm and coconut derived surfactants. Embodiments are particularly effective, mild and non-hazardous for cleaning solar panels, glass, glass composites, polymers and the like.

14 Claims, No Drawings

CLEANING FORMULATIONS AND METHODS OF USE THEREOF

BACKGROUND OF THE INVENTION

Field of the Invention

The invention relates to cleaning formulations and compositions and method of use thereof. More particularly, the invention provides a cleaning formulation and a method of using the cleaning formulation for cleaning, treating and protecting the surface of substrates such as solar panels, polymers, glass, glass composites and other similar washable surfaces. The invention also relates to method of use for detergent and dust repellant. The cleaning formulation removes soil from the substrate surface without the use of harsh chemicals. It dramatically improves cleaning without etching or hazing the surface of the substrate. The cleaning formulation is effective in surface protection and treatment which imparts resistance to the deposition and adherence of unwanted dust, grime, oil, tar, rubber, bug residues or other soil on the surface over a wide range of temperatures.

Solar panels need to be housed, supported and directed toward light sources. These rigid panels are integrated into structures that may contain plastic, glass composites, fiberglass and metal parts to create a support frame. These frames may also be movable, allowing either manual or automated redirection of the panels to capture and convert optimum amounts of solar energy. However, dust, dirt, debris, bug residues, snow and other soil materials collect on the panels over time and reduce the panel efficiency and capacity to produce electrical power. Dirt, dust and other material build-up on the panels prevent sunlight from reaching the critical elements in the panel material, thus reducing electrical output by five to fifteen percent or more. With frequent cleaning, for instance three to four times a year, depending on their location and environment, the solar panels can perform as optimally designed.

It would therefore be advantageous to provide a cleaning formulation for cleaning the solar panels in order to maximize their full potential in providing a cost effective and sustainable source of electricity.

In particular, it is advantageous to condition the substrate surface such that it responds in a hydrophobic manner. For example, hydrophobic surfaces tend to repel most soils and stains and would thus be easier to clean. Surface of substrates such as glass, glass composites, plexiglass, fiberglass, polymers, plastic, fabrics, ceramics, porcelain, concrete or wood can be hydrophobically modified for ease of cleaning with anti-staining benefits. A hydrophobic surface condition on the substrates would also promote desirable textural characteristics including smoothness and lubricity.

Many of the cleansers and cleaning chemicals available for consumer use can be shown to be damaging to the environment and/or harmful to humans. The cleaning formulation of the present invention is in combination with an environmental impurity resistance mixture prior to use.

While the art is replete with a myriad of products aimed at providing one or more of these benefits, there continues to be a search for improved means to deliver these benefits as described.

Garabedian, U.S. Pat. No. 5,252,245 and U.S. Pat. No. 5,437,807, provides an aqueous hard surface cleaner containing an alkanol or alkylene glycol ether, a surfactant selected from amphoteric, nonionic, and anionic surfactants or mixtures thereof; and an effective amount of a nitrogenous buffer. To avoid streaking, sodium ions are avoided and the amount of surfactant is kept to a minimum.

Garabedian, U.S. Pat. No. 5,468,423, provides an aqueous hard surface cleaner containing an alkanol or alkylene glycol ether, a nonionic surfactant, and an effective amount of a nitrogenous buffer.

Graubart, U.S. Pat. No. 5,454,984, provides a cleaning composition containing a quaternary ammonium compound component, a nonionic surfactant, and a glycol ether component, with optional chelators.

Sokol, U.S. Pat. No. 4,020,016, provides aqueous cleaning compositions containing one or more nonionic surfactants, nitrogen containing salts of nitrilotriacetic acid or an alkylene polyamine polycarboxylic acid, and water, wherein the composition is substantially free of sodium ions.

U.S. Pat. Nos. 3,123,640 and 3,141,905 describe cation-active surface active chemical compounds, the latter patent specifically describing their use for bactericidal, germicidal, antiseptic, algaecidal, fungicidal, textile softening, corrosion inhibition, antistatic, emulsifying, foam modifying, ore beneficiation, and various other purposes.

There exists a need for a chemical formulation that reduces the accumulation of dust, soil, dirt and grime on soiled substrate surfaces, which can also clean oil, tar, bug residues and other similar substances and yet will not damage the surfaces of the substrate, while enabling the substrate surfaces to repel the accumulation of these substances.

SUMMARY OF THE INVENTION

The present invention provides a cleaning formulation having improved residue removal capabilities and substantially reduces tendencies for filming or streaking, said formulation comprising of the following:

(a) An effective amount of citrus based compounds and mixtures thereof;

(b) Effective amounts of surfactants selected from primary and secondary nonionic surfactants and co-surfactants;

(c) Effective amounts of wetting agents; and (d) Optimally, an effective amount of environmental impurity resistance mixture comprising of an effective amount of cationic emulsifiers and anionic emulsifiers selected from a group of dialkyl quaternary amines, salts of condensation products of fatty acids with sarcosine and mixtures thereof; an organic solvent mixture selected from a group of alkyl alcohol, alkyl ethers and mixtures thereof; an effective amount of siloxanes selected from a group of alkylsiloxane, cyclosiloxane, alkylcyclosiloxane and mixtures thereof; an effective amount of quaternary ammonium compounds selected from a group of soy, palm and coconut derived compounds and mixtures thereof; and buffering agent comprising of a alkaline hydroxide or an organic base, in particular, either ammonia or an alkyl amine.

In yet a further objective of the invention, it has been additionally found that particular primary surfactants selected from a group consisting of secondary alcohol ethoxylate surfactants, primary alcohol ethoxylate surfactants, glycol ethers, or mixtures thereof will further enhance cleaning performance.

In yet a further objective of the invention, the cleaning formulation comprises of wetting agents selected from a group consisting of nonionic alcohol ethoxylates, ether ethoxylates, or silicone glycol copolymers.

In yet a further objective of the invention, the cleaning formulation comprises of secondary surfactants selected from a group consisting of ether amine oxide surfactants, ether amines and derivatives.

In yet a further objective of the invention, the cleaning formulation comprises of a co-surfactant selected from a group with solvent Hydrophilic and/or Hydrophobic properties consisting of glycol ether surfactants, diacyl glycerols, ether ethoxylates, or alkyl glycol ethers.

In yet a further objective of the invention, the cleaning formulation comprises of an emulsifier and drying compounds selected from a group consisting of dialkyl quaternary amine, quaternary ammonium compounds, ethoxylated quaternary compounds, quaternary ammonium alkyl sulfates, ether amine quaternary ammonia chlorides or quaternary ammonium alkyl chlorides.

It is an objective of the present invention to provide a cleaning formulation which can be used by itself or combined with an environmental impurity resistance mixture to remove dust, dirt, grime, bug residue or other soiled materials from a substrate surface for improved immediate and long term maintenance of the clean surface.

It is a further objective of the present invention to provide an environmental impurity resistance mixture for enhanced cleaning performance, said mixture comprising a cationic compound, an alkyl siloxane nonionic polyether surfactant and a mixture of cyclosiloxanes and alkylcyclosiloxanes.

It is a further objective of the present invention to provide an environmental impurity resistance mixture for enhanced cleaning performance, said mixture comprising cationic compounds selected from a group consisting of quaternary amine compounds, quaternary ammonium salts and quaternary ammonium compounds.

It is a further objective of the present invention to provide an environmental impurity resistance mixture for enhanced cleaning performance, said mixture comprising of the salts of condensation products of fatty acids with sarcosine selected from a group consisting of sodium oleoyl sarcosinate, sodium cocoyl sarcosinate, sodium lauroyl sarcosinate and mixtures thereof.

It is a further objective of the present invention to provide an environmental impurity resistance mixture for enhanced cleaning performance, said mixture comprising cyclosiloxanes and alkylsiloxanes, said cyclosiloxanes selected from a group consisting of hexamethylcyclotrisiloxane, octamethylcyclotetrasiloxane, decamethylcyclopentasiloxane, or dodecamethylcyclohexasiloxane.

In yet a further objective of the invention, the cleaning formulation can be used on a variety of substrate surfaces such as glass, glass composites, plexiglass, fiberglass, polymers, plastic, fabrics, ceramics, porcelain, concrete or wood and the like.

It is an additional aspect of the invention to enhance the performance of the buffering system by adding a co-buffer, such as an alkaline hydroxide or an organic base, in particular, either an ammonium or alkaline earth metal hydroxide or ethanol amine.

The invention further comprises a method of removing soils from substrate surfaces by applying said inventive cleaning formulation to said soil, and removing both from said surface and applying said inventive soil resistance formulation to said clean surface, and removing said residual formulation from said surface.

It is therefore an objective of this invention to improve soil removal from substrate surfaces and to enable the surfaces to shed and repel accumulation of soil, dust, dirt, grime and the like on the surfaces.

It is a still further objective of this invention to improve overall cleaning performance of substrate surfaces by using an improved cleaning formulation comprising of (a) an effective amount of citrus based compounds and mixtures thereof; (b) an effective amount of a surfactant selected from primary and secondary nonionic surfactants, co-surfactants and mixtures thereof; (c) a wetting agent; (d) an emulsifier; and (e) optimally, an environmental impurity resistance mixture.

It is also an objective of this invention to provide a cleaning formulation for solar panels and other glass and similar surfaces, which has virtually no filming or streaking.

These and other features, aspects, and advantages of the present invention will become evident to those skilled in the art from the following detailed description.

DETAILED DESCRIPTION OF THE PREFERRED EMBODIMENTS

The objective of the present invention therefore includes providing an all-purpose cleaning formulation which is environmentally acceptable, has good substrate compatibility, and is effective in the removal of grit, grease, oil, bug residues, soil, grime, difficult to remove residues and other similar materials from substrate surfaces. So that the invention may be understood more clearly, certain terms are first defined.

The term "soil" refers to dirt, grime, dust, bug residues, road grime, road dirt, mud, filth, strains grease; i.e., the state of being covered with unclean things. Many different types of soiling may also occur. For example, the soiling may originate from fuels, lubricants, hydraulic and other operating fluids, dirt, components of vehicle exhaust materials, residues of previously used detergents, waxes and the like. Firmly adhering residues containing metal dust and/or abraded metal are particularly difficult to remove.

It is well known that external surfaces of substrates such as solar panels, glass or motor vehicle windshield accumulate various forms of foreign matter. The foreign matter commonly termed "dirt" comprises dust, mud, residues from insects, and the like. The "film dirt" comprises of a hydrophobic film which is often called road film and composed of organic material such as unburned fuel, lubricating oil, products of fuel combustion, and the like, which are emitted from vehicles, and/or thrown up from the road surfaces by the passage of vehicles. The smear or film formed called "lace curtain effect" on the windshield obscures vision and is often difficult to remove by means of typical cleaning compositions. The dirt is not readily noticeable under a variety of lighting conditions where the intensity of the light from the surroundings does not differ greatly from that of the interior of the vehicle. However, the dirt becomes highly noticeable, when the light intensity on the two sides of the glass differs greatly—from a darkened vehicle, the film causes the glass to tend to act as a mirror; approaching a brilliant light source, such as the sun near the horizon, or the lights of an oncoming vehicle the film increases "glare" and also may cause the glass to tend to act as a mirror. In both situations, visibility through the glass is markedly reduced, which can increase the danger of operating the vehicle. Another situation when the film dirt becomes highly visible to the detriment of vision through the glass is when condensed moisture appears on the outer surface of the glass, the wiping action of the windshield wiper, or a cloth, used to remove the moisture, causes a smearing action resulting in streaking or "fogging" on the substrate. Similarly, obscurity of the surface of solar panels reduce the panel's efficiency to provide optimum solar energy conversion to electricity.

It is relatively easy to remove the regular dirt, but very difficult to remove the smear dirt. These glass contamination problems are discussed in some detail in such patents as U.S. Pat. Nos. 2,313,425; 3,304,264 and 3,309,321.

To be useful for cleaning such glass surfaces, a cleaning formulation must be able to remove the smear dirt as well as the regular dirt. Moreover, the formulation must be capable of use on substrate surfaces under an expected range of climatic conditions—it must not freeze at low temperatures, nor evaporate at unduly high rates at the high temperatures that may be encountered in use of the substrate—and it must be compatible—that is, it must not corrode metals it contacts such as the parts of the washing equipment and metal trim around the glass or adversely affect the body finish of the solar panels. It is common practice to market an "all-weather" formulation for use in both summer and winter. Such a formulation ordinarily is sold as a concentrate which is suitable for use in winter—i.e., it has a low freezing point. The concentrate then is diluted with water to prepare a formulation suitable for summer use—i.e., it has a relatively high freezing point but relatively low volatility, since if the formulation dries too quickly, it may dry before cleaning of the glass has been effected or may interfere with the cleaning. It is always desirable to use as dilute a formulation as possible employing minimum amounts of chemicals to reduce any possible contamination of the environment and to reduce the cost of using the formulation.

As used herein, the term "cleaning" includes a variety of ways of treating to improve the quality or appearance of an article or treating an article to provide a benefit (e.g., cleaning treatment; waxing or polishing; removing soap or salt films, scum or deposits; removing grit or grime; improving the finish or soil resistance of the surface and the like). Cleaning a hard or metal surface can include cleaning the surface, removing corrosion from the surface, removing tarnish from the surface, and the like.

As used herein, volume percent, percent by volume, % by volume (% V), and the like are synonyms that refer to the concentration of a substance as the volume of that substance divided by the volume of the composition and multiplied by 100.

As used herein, the term "about" modifying the quantity of an ingredient in the compositions of the invention or employed in the methods of the invention refers at least to variation in the numerical quantity that can occur, for example, through typical measuring and liquid handling procedures used for making compositions in the real world; through inadvertent error in these procedures; through differences in the manufacture, source, or purity of the ingredients employed to make the compositions or carry out the methods; and the like. Whether or not modified by the term "about", the claims include equivalents to the quantities. The term "approximately" is configured substantially to come near or close in degree, nature, quality or other characteristics regarding the properties of the claimed invention. The term "about" would serve to modify the quantity of the component in a way consistent with its ordinary meaning of "approximately". The terms approximately" or "about" or "substantially" may not require construction by the court. Where "construing" a claim term would involve simply substituting a synonym for the claim term, it may be appropriate to allow the claim language to speak for itself.

As used herein the term "very slightly water-soluble" means that polar organic compounds useful in the invention are soluble in water at concentrations ranging from about 0.01 to about 1.0 weight percent at 20° C. The term "water soluble" means that an organic compound (glycol ether or alkyl alcohol, for example) has a water solubility of 1.0 weight percent or greater in water at 20° C.

The term "effective amount" or "approximately" mean that amount necessary to formulate a composition which is non-streaking on hard surfaces, where "non-streaking" means there is no residue apparent to the human eye under a standard light source.

"Substrate surface" is meant to include surfaces such as solar panels, glass, glass composites, plastic, glass window panes, ceramic tiles, marble, metals, terrazzo, and the like. The term "fibrous substrate" is meant to include relatively porous materials such as carpet, upholstery, clothing, and the like, and is meant to exclude hard surfaces such as glass, ceramic tile, and the like.

The term "HLB" value refers to hydrophobic lipophilic balance value. It is a measure of water solubility and ability to give good emulsification which are critical properties for a cleaning composition. In general, formulations with an HLB value of less than about 10 tend to be poorly soluble in water. A key property held in common by these formulations is an HLB value greater than 11 but less than 15 as described in the ranges below.

A value from 7 to 11 indicates a W/O (water in oil) emulsifier

A value from 12 to 16 indicates 0/W (oil in water) emulsifier

A value from 11 to 14 indicates a wetting agent

A value from 12 to 15 indicates a detergent

A value of 16 to 20 indicates a solubilizer or hydrotrope

Surfactants are substances which lower the surface tension of a liquid allowing easier spreading and lowering of the interfacial tension between two liquids or between a solid and a liquid. Typically, surfactants have a characteristic structure and have at least one hydrophilic and at least one hydrophobic functional group. If both parts of the molecule are in equilibrium relative to one another, the substance will accumulate and orient itself at an interface, i.e., hydrophilic groups point, for example, to an aqueous phase and the hydrophobic groups in the direction of other solid, liquid or gaseous phases. A further special feature of the surfactants is the formation of higher aggregates, the so-called micelles. With these, the surfactant molecules arrange themselves in such a way that the polar groups form, for example, a spherical shell. This has the effect of solubilizing substances such as dirt particles in an aqueous solution with the formation of micelles.

The invention provides a cleaning formulation having improved residue removal and substantially reduced filming or streaking, said formulation comprising: (a) an effective amount of citrus based compounds and mixtures thereof; (b) effective amounts of surfactants selected from primary and secondary nonionic surfactants, co-surfactants; (c) effective amounts of wetting agents; and (d) optimally, an environmental impurity resistance mixture comprising an effective amount of cationic emulsifiers and anionic emulsifiers selected from a group of dialkyl quaternary amines, salts of condensation products of fatty acids with sarcosine and mixtures thereof; e) an organic solvent mixture selected from a group of alkyl alcohol, alkyl ethers and mixtures thereof; 0 an effective amount of siloxanes selected from a group of alkylsiloxane, cyclosiloxane, alkylcyclosiloxane and mixtures thereof; g) an effective amount of one to four different quaternary ammonium compounds selected from a group of soy, palm and coconut derived compounds and mixtures thereof; and h) a buffering agent consisting of a alkaline hydroxide or an organic base in particular, either ammonia or an alkyl amine.

Another embodiment of the invention relates to cleaning formulation wherein said effective amount of cationic compound 1 such as cocoalkylbis(hydroxyethyl)methylethoxylated chlorides is about 0.01% V to about 10.0% V, more preferably 0.02% V to about 5.0% V; most preferably, about 0.2% V to about 1.0% V or about 0.1% V to about 5.0% V.

Another embodiment of the invention relates to cleaning formulation wherein said effective amount of cationic compound 2 such as ethyldimethylsoya alkyl ethyl sulfate is about 0.01% V to about 10.0% V, more preferably 0.01% V to about 5.0% V; most preferably, about 0.2% V to about 1.0% V or about 0.1% V to about 5.0% V.

Another embodiment of the invention relates to cleaning formulation wherein said effective amount of cationic compound 3 selected from emulsifier, fatty acids, coco, reaction products and diethylenetriamine and soya fatty acids, ethoxylated chloromethane-quaternized is about 0.01% V to about 10.0% V, more preferably 0.02% V to about 5.0% V; most preferably, about 0.03% V to about 1.0% V or about 0.1% V to about 5.0% V.

Another embodiment of the invention relates to cleaning formulation wherein said effective amount of cationic compound 4 selected quaternary ammonium compounds is about 0.1% V to about 10.0% V, more preferably 0.1% V to about 5.0% V; most preferably, about 0.3% V to about 1.0% V.

Another embodiment of the invention relates to cleaning formulation wherein said effective amount of salts of condensation products of fatty acids with sarcosine is selected from a group consisting of sodium oleoyl sarcosinate, sodium cocoyl sarcosinate, sodium lauroyl sarcosinate and mixtures thereof is about 0.01% V to about 10.0% V, more preferably 0.1% V to about 5.0% V; most preferably, about 0.3% V to about 1.0% V.

Another embodiment of the invention relates to cleaning formulation wherein said effective amount of siloxane polyether surfactant such as 3-(3-Hydroxypropyl)-heptamethyltrisiloxane, ethoxylated, hydroxy-terminated is 0.01% V to about 10.0% V, more preferably 0.1% V to about 5.0% V; most preferably, about 0.3% V to about 1.0% V.

Another embodiment of the invention relates to cleaning formulation wherein said effective amount of alkylcyclosiloxane or polyether surfactant such as 3-(3-Hydroxypropyl)-heptamethyltrisiloxane, ethoxylated, hydroxy-terminated is about 0.01% V to about 10.0% V, more preferably 0.02% V to about 5.0% V; most preferably, about 0.03% V to about 1.0% V.

Another embodiment of the invention relates to a cleaning formulation wherein the citrus based compounds, or citrus derived compounds, are selected from a group consisting of Citrus Terpenes or d-limonene, more preferably, a mixture of citrus derived compounds; most preferably, a mixture of terpenes and citrus derived non-ionic surfactants.

Another embodiment of the invention relates to a cleaning formulation wherein the said effective amount of citrus based compound is about 0.001% V to about 7.0% V; more preferably, about 0.01% V to about 2.0% V; most preferably, about 0.05% V to about 1.0% V.

Another embodiment of the invention relates to a cleansing formulation wherein the formulation comprises at least one primary surfactant, at least one secondary surfactant and at least one co-surfactant.

Another embodiment of the invention relates to a cleansing formulation wherein the formulation comprises at least one primary surfactant with the structural formula:

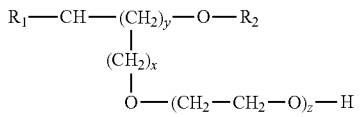

wherein $R_1$ is an aliphatic hydrocarbon radical with 4 to 18 carbon atoms, $R_2$ is an aliphatic hydrocarbon radical with 4 to 8 carbon atoms, x and y are integers 0 and 1, z is a value greater than 1, the sum of the carbon atoms of $R_1$ and $R_2$ is from 8 to 26 and the sum of x+y is 1.

Another embodiment of the invention relates to a cleaning formulation wherein the primary nonionic surfactant is selected from a group consisting of secondary alcohol ethoxylate, or ethoxylated alcohols $C_8$-$C_{16}$, more preferably, ethoxylated secondary alcohol ($C_{12}$-$C_{14}$), most preferably, a mixture of ethoxylated alcohols $C_9$-$C_{11}$ and ethoxylated alcohols $C_{10}$-$C_{16}$.

Another embodiment of the invention relates to a cleaning formulation wherein the effective amount of primary nonionic surfactant is about 0.001% V to about 10% V, more preferably, 0.01% V to about 4.0% V; most preferably, 0.02% V to about 4.0% V.

Another embodiment of the invention relates to a cleaning formulation wherein the secondary nonionic surfactant is selected from amine oxide having the general structure:

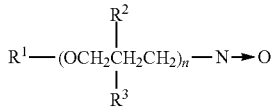

wherein $R^1$ is selected from an alkyl group having between 8 and 12 carbon atoms; n is 1 or 2; and $R^2$ and $R^3$ are each at least one alcohol unit and the total number of alcohol units present in $R^2$ and $R^3$ is about 2.

Another embodiment of the invention relates to a cleaning formulation wherein the effective amount of amine oxide surfactant is about 0.01% V to about 10% V; more preferably, 0.02% V to about 1.0% V; most preferably, 0.03% V to about 1.0% V.

Another embodiment of the invention relates to a cleaning formulation wherein the secondary nonionic surfactant is selected from poly ether polyols; or more preferably, glycol ether; most preferably ether ethoxylates surfactant.

Another embodiment of the invention relates to a cleaning formulation wherein the effective amount of secondary nonionic surfactant is about 0.01% V to about 10% V; more preferably, 0.02% V to about 5.0% V; most preferably, 0.03% V to about 1.0% V.

Another embodiment of the invention relates to a cleaning formulation wherein the co-surfactant is selected from a group consisting of glycol ether surfactant, polyether polyols; more preferably, glycol butyl ethers; most preferably, glycol propyl ethers.

Another embodiment of the invention relates to a cleaning formulation wherein the effective amount of the co-surfactant is about 0.01% V to about 10% V; more preferably, 0.02% V to about 5.0% V; most preferably, 0.03% to about 1.0% V;

Another embodiment of the invention relates to a cleaning formulation wherein wetting agents are selected from a group of siloxanes selected from a group of alkylsiloxane, cyclosiloxane, alkylcyclosiloxane and mixtures thereof.

Another embodiment of the invention relates to a cleaning formulation wherein the effective amount of the wetting agent siloxane mixture is about 0.01% V to about 10% V; more preferably, 0.1% V to about 5.0% V; most preferably, 0.3% V to about 1.0% V;

Another embodiment of the invention relates to a cleaning composition wherein the environmental impurity resistance mixture comprises cationic emulsifiers, an organic solvent mixture selected from a group of alkyl alcohol, alkyl ethers and mixtures thereof, siloxanes selected from a group of alkylsiloxane, cyclosiloxane, alkylcyclosiloxane and mixtures thereof, quaternary ammonium compounds selected from a group of soy bean, palm and coconut derived compounds and mixtures thereof, and buffering agent consisting of an alkaline hydroxide or an organic base, in particular, either an ammonium or alkyl amine.

Another embodiment of the invention relates to a cleaning formulation wherein the cationic emulsifier comprises of quaternary ammonium compounds having the structural formula:

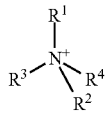

wherein $R^1$ and $R^2$ may be the same or different and are selected from alkyl and substituted alkyl groups such as methyl, ethyl, propyl, isopropyl, hydroxyethyl, hydroxypropyl, and the like. $R^3$ is typically and preferably a straight or branched alkyl moiety having from about 10 to 18 carbon atoms. $R^4$ is selected from the group consisting of alkyl groups having from 1 to about 5 carbon atoms.

Another embodiment of the invention relates to a cleaning formulation with a nonionic surfactant having the structural formula:

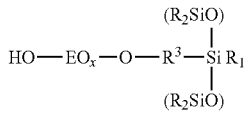

Wherein $R_2$ and $R^3$ represent a nonionic group, preferably $CH_3$ and —$CH_2$—$(CH_2)_p$. EO representing ethylene oxide, x is a number that ranges from about 0 to about 20, $R_1$ is an alkyl $C_{1-6}$.

Another embodiment of the invention relates to a cleaning formulation with a nonionic surfactant selected from the group consisting of alkyl siloxane nonionic polyether surfactant, hexamethyldisiloxane, dodecamethylcyclohexasiloxane; and mixtures of octamethylcyclotetrasiloxane and decamethylcyclopentasiloxane.

Another embodiment of the invention relates to a cleaning formulation, comprising:

(a) Approximately about 0.05 to 1% V of citrus based compounds and mixtures thereof;

(b) Approximately about 0.25 to 1% V of a surfactant selected from primary and secondary nonionic surfactants, co-surfactants and mixtures thereof;

(c) Approximately about 0.05 to 2% V of a wetting agent; and (d) Optimally, approximately about 0.1 to 5% V of an environmental impurity resistance mixture.

Another embodiment of the invention relates to a cleaning composition, comprising:

a) An effective amount of citrus based compounds and mixtures thereof selected from the group consisting of citrus terpenes or d-limonene;

(b) An effective amount of a surfactant selected from primary and secondary nonionic surfactants, co-surfactants and mixtures thereof; said primary nonionic surfactant selected from the group consisting of alcohols $C_9$-$C_{11}$; ethoxylated alcohols $C_{10}$-$C_{16}$ or mixtures thereof; said secondary nonionic surfactants selected from the group consisting of secondary alcohol ethoxylates, alcohols $C_{12}$-C14, or; alcohols $C_8$-$C_{10}$, said co-surfactant selected from the group consisting of glycol ethers, ether ethoxylates, or ether amine oxides;

(c) A wetting agent selected from the group consisting of polyoxyethylene ($C_{13}$) ether (ethoxylate), silicone glycol copolymers, or alcohols, $C_8$-$C_{10}$;

d) An emulsifier selected from the group consisting of dialkyl quaternary amines, ether amine oxides or ethoxylated quaternary compounds, polyoxyethylene alkylamine quaternary and mixtures thereof.

(e) Optimally, an environmental impurity resistance mixture comprising of quaternary ammonium compounds; an alkyl siloxane nonionic polyether surfactant and a mixture of cyclosiloxane and alkylcyclosiloxane; wherein said alkylsiloxane nonionic polyether surfactant is selected from a group consisting of silicone polyether (glycol) copolymers, poly(ethylene oxide or propylene oxide) monoallyl ether acetate; said cyclosiloxane selected from a group consisting of octamethylcyclotetrasiloxane and/or decamethylcyclopentasiloxane, and said alkylcyclosiloxane selected from a group consisting of polydimethylsiloxane.

Another embodiment of the invention relates to a cleaning formulation, comprising:

a) an effective amount of a primary surfactant mixture comprising $C_9$-$C_{11}$ ethoxylated alcohol and $C_{10}$-$C_{16}$ ethoxylated alcohols;

b) an effective amount of a secondary primary surfactant comprising polyoxyethylene ($C_{13}$) ether ethoxylate;

c) an effective amount of a cosurfactant comprising dipropylene glycol n-propyl ether;

d) an effective amount of a secondary surfactant comprising Ethanol, 2-2'-iminobis,-n-[3-(branched decyloxy)propyl)] derivs, N-oxides 2-propanol;

e) an effective amount of a secondary surfactant secondary alcohol ethoxylate;

f) an effective amount of a citrus based solvent comprising citrus terpenes nonionic surfactant;

g) an effective amount of an environmental impurity resistance mixture comprising i) Cationic Compound 1 comprising coco alkylbis(hydroxyethyl) methyl, or ethoxylated, chlorides; ii) Cationic Compound 2 comprising ethyldimethylsoya alkyl ethyl sulfate; iii) Cationic Compound 3 comprising mulsifier, fatty acids, coco, reaction products and diethylenetriamine and soya fatty acids, ethoxylated, chloromethane quaternized; and iv) Cationic Compound 4 comprising quaternary ammonium compounds;

h) Sodium Lauroyl Sarcoscinate;

i) Siloxane Polyether Surfactant comprising 3-(3-Hydroxypropyl)-heptamethyltrisiloxane, ethoxylated, Hydroxy-terminated;

j) Alkylcyclosiloxane Decamethylcyclopentasiloxane; and k) Buffer 25% ammonia hydroxide.

Another embodiment of the invention relates to a cleaning formulation, comprising of: (a) A mixture of citrus based compounds; (b) A nonionic surfactant selected from secondary alcohol ethoxylate surfactant; (c) A wetting agent; (d) An ether amine oxide surfactant; (e) A glycol ether surfactant; (f) A dialkyl quaternary amine emulsifier; and (g) Optimally, an environmental impurity resistance mixture comprising of soy and coconut derived quaternary ammonium compounds, an alkyl siloxane nonionic polyether surfactant and a mixture of cyclosiloxane and alkylcyclosiloxane.

Another embodiment of the invention relates to a method of cleaning a soiled surface, without substantial residue remaining, comprising applying the cleaning formulation whether mixed with other substances or alone, in quantities of water to said soil and removing the said soil and said cleaning formulation.

Another embodiment of the invention relates to a method of cleaning a soiled surface, said surface selected from a group consisting of glass, rubber, coated surfaces, steel and aluminum, plastics materials, composites, thermoplastic polymer fabrics, thermoplastic polymer fibers, glass or metal composites and the like.

Surfactants which have one hydrophobic constituent and one hydrophilic constituent are widespread. However, their tendency toward foaming renders them unusable or only usable to a limited extent for many applications. For this reason, nonionic surfactants in particular have been proposed which have a second hydrophobic block so that the foam volume is limited.

The primary nonionic surfactants suitable for the present invention comprise water soluble alcohol ethylene oxide condensates of a secondary aliphatic alcohol containing from 9 to 18 carbon atoms in a straight or branched configuration, condensed with from 5 to 30 moles, preferably from about 7 to 12 moles, of ethylene oxide. Examples of preferred commercially available surfactants of this composition are $C_{11}$-$C_{15}$ secondary alkanols condensed with 7, 9, or 12 moles of ethylene oxide, available from Union Carbide under the tradenames Tergitol™ 15-S-7, 15-S-9, and 15-S-12, for example, believed to comprise alkyloxypolyethylene oxyethanol. Additional suitable surfactants of the same type are marketed by Union Carbide under the tradenames Tergitol™ TMN-6 and TMN-10, believed to comprise reaction products of trimethyl-nonanol with ethylene oxide. Alcohol alkoxylates are commercially available, for example as the Plurafac™ surfactants of BASF Corporation.

Suitable non-ionic surfactants are known in the art. Suitable non-ionic surfactants include polyethoxylates, polyether alcohols, branched secondary alcohol ethoxylates (Tergitol™ TMN series, Dow Chemical, Midland, Mich.), ethylene oxide/propylene oxide copolymers (Tergitol™ L Series, Tergitol™ XD, XH, and XJ, Dow Chemical, Midland, Mich.), nonylphenol ethoxylates (Tergitol™ NP Series, Dow Chemical, Midland, Mich.), octylphenol ethoxylates (Triton™ X Series, Dow Chemical, Midland, Mich.), secondary alcohol ethoxylates (Tergitol™ 15-S Series, Dow Chemical, Midland, Mich.), glycol esters, triglyceride ethoxylates, alkanolamides, sorbitan ester ethoxylates, linear and branched alcohol alkoxylates, fatty alcohol ethoxylates, block co-polymer products, and combinations thereof. In some preferred embodiments, the nonionic surfactant comprises an octylphenol ethoxylate (Triton™ X).

In an embodiment of the cleaning formulation of the present invention, at least one nonionic surfactant may optionally be present in an amount sufficient to aid in removing oily soils. In an embodiment, the nonionic surfactant may be present in an amount ranging between about 0.05% V and about 4% V of the cleaning formulation. In an alternate embodiment, the nonionic surfactant may be present in an amount ranging between about 0.1% V and about 2% V of the cleaning formulation; more preferably, amount ranging between about 0.15% V and about 1% V of the cleaning formulation; most preferably, amount ranging between about 0.2% V and about 0.5% V of the cleaning formulation.

It is to be understood that any suitable nonionic surfactant may be used. In a non-limitative embodiment, the nonionic surfactants include, but are not limited to ethoxylated alcohol nonionic surfactants, alkyl phenol ethoxylates; glycol esters; alkyl polyglycosides; and mixtures thereof.

The nonionic surfactant is preferably selected from the group consisting of alcohol alkoxylates, alcohol block alkoxylates, polyoxyethylene polyoxypropylene block surfactants, and mixtures thereof. Surfactants with a wide range of hydrophile-lipophile balance (HLB) can be used in the present invention. The nonionic surfactant preferably will have an HLB of greater than about 11, and more preferably greater than or equal to about 12 to 14.

It has also been discovered that if branched chain ether amine oxide surfactants are used in combination with a very slightly water-soluble polar organic compound and a water-soluble glycol ether, the characteristics of excellent grease removal and non-streaking are present, and the composition is low-foaming. "Low-foaming" as used herein means that compositions of the invention employing branched chain ether amine oxides as the surfactant produce less foam than the same composition using a straight chain ether amine oxide surfactant. This is especially advantageous when the compositions of the invention are employed on substrates such as glass or glass composites. In some instances it may be desired to employ the straight chain ether amine oxides when foaming of the composition is desired.

Other cationic/nonionic surfactants may also be effective in formulations of this invention. However, most cationic surfactants appear to comprise relatively strong cationic moieties when dispersed in acidic media, which may be responsible for surfactancy. Most nonionic surfactants, on the other hand, have essentially no charge when dispersed in alkaline or neutral aqueous media, and are more effective on greasy soil/stains. Thus, the amine oxide surfactants are utilized because of their uniquely effective cleaning characteristics due to their mixed cationic/nonionic moiety.

Particularly preferred secondary non ionic surfactants are amine oxides useful in the present invention with a general formula:

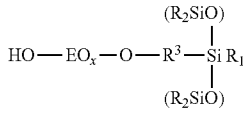

Wherein $R_2$ and $R^3$ represent a nonionic group, preferably $CH_3$ and $—CH_2—(CH_2)_p$. EO represents ethylene oxide and x is a number that ranges from about 0 to about 20.

Ether amine oxides having branched $R^3$ heteroalkyl groups, such as that known in the trade designation "A0-14-2", available from EXXON Chemical Company, Houston, Tex., in which amine oxides, which act as nonionic materials in alkaline media and weakly cationic materials in acidic media, have been reported in U.S. Pat. No. 4,714,610 to exhibit effective conditioning properties in compositions having a pH of about 2.4 to about 3.8.

Alkoxylated amine oxides are another group of amine oxides understood to be high foaming. For example, U.S. Pat. No. 3,449,431 (Swenson) repeatedly characterizes certain alkoxylated amine oxides as suds builders and not as low foaming surfactants.

Representative examples of suitable degreasers include a wide variety of organic solvents and generally include materials such as ketones, amines, esters, tetrahydrofuran or other heterocycles, alcohols, ethers, glycol ethers, combinations of these, and the like. Of these, one or more glycol ethers are particularly preferred for a variety of reasons. Glycol ethers have excellent oil dissolving capabilities. These compounds solubilize oil very quickly. It is believed that glycol ethers combine the solvent characteristics of both alcohols and ethers. Additionally, glycol ethers tend to form compatible, single phase mixtures with the other components of the cleaning composition, significantly without unduly compromising the cleaning power of other ingredients. The volatility of glycol ethers is also in a suitable regime so that the cleaning formulation incorporating these materials dry at a rate that is not too fast or too slow. Glycol ethers also are compatible with the vehicle environment. When included as a constituent of the present invention, these compounds do not damage LEXAN brand polycarbonates such as those used as windshield components, MYLAR polyester, the silicone seal of such windshields, the paint finish on the vehicles, or many decals.

Glycol ethers may be made by reacting alcohols and ethylene oxide in accordance with conventional methods. Glycol ethers also are widely available from a number of commercial sources. Specific examples include propylene glycol n-butyl ether (Dow Chemical Company), propylene glycol n-propyl ether (Dow Chemical Company), diethylene glycol monobutyl ether (Eastman Chemical Co.), ethylene glycol monobutyl ether (Eastman Chemical Co.), dipropylene glycol methyl ether, (Dow Chemical Company) propylene glycol methyl ether (Dow Chemical Company).

The combination of a glycol ether with the surfactant system of the present invention allows a faster water film dry out time and also provides a minimum of residue left on the surface being cleaned.

The glycol ether component which has a synergistic effect with the surfactant system is preferably an alkylene glycol alkyl ether. The alkylene is preferably ethylene or propylene and the alkyl group is preferably a $C_1$-$C_6$ carbon chain. Other glycol ethers suitable for use include mono- or dialkyl ethers of alkylene glycols or polyalkylene glycols having up to 6 carbon atoms per glycol group and up to 6 carbon atoms in each alkyl group. A preferred example for use is Dipropylene Glycol n-Propyl Ether. Other examples include propylene glycol n-butyl ether, dipropylene glycol n-butyl ether, propylene glycol n-propylene, diethylene glycol n-butyl ether, diethylene glycol methyl ether, dipropylene glycol methyl ether, and the like.

The glycol ether is present in an amount of from 0.01 to about 10% V. Preferably, the glycol ether is present in an amount of 0.1% V to about 4% V. A preferred range for the glycol ether is about 0.2 to about 1% V.

Other examples of glycol ethers are the cellosolves, including ethylene glycol monomethyl ether (methyl cellosolve), ethylene glycol monobutyl ether (butyl cellosolve), and ethylene glycol mono-n-hexyl ether, diethylene glycol monomethyl ether, diethylene glycol monobutyl ether, dipropylene glycol monomethyl ether and dipropylene glycol monobutyl ether. Dipropylene glycol n-propyl ether is particularly preferred since it is highly effective in the cleaning formulation of the invention and for Environmental Considerations.

Ethylene glycol 2-ethylhexyl ether is available under the trade designation "Ektasolve EEH" from Eastman Chemical Products, Inc., Kingsport, Tenn. Ethylene glycol hexyl ether is available under the trade designation hexyl "Cellosolve" from Union Carbide Corporation.

Examples of water soluble glycol ethers useful in the invention are many and include the following water miscible glycol ethers: ethylene glycol methyl ether, ethylene glycol ethyl ether, ethylene glycol mono-n-butyl ether, diethylene glycol methyl ether, diethylene glycol ethyl ether, methoxy triglycol, ethoxy triglycol, butoxy triglycol, 1-butoxyethoxy-2-propanol, propylene glycol n-propyl ether, propylene glycol methyl ether, dipropylene glycol methyl ether, and 3-methyl-3-methoxybutanol. Another useful glycol ether is propylene glycol mono-t-butyl ether, (water solubility of 14.5 weight % at 20° C.). Combinations of the above water soluble glycol ethers may also be employed. A particularly preferred glycol ether which exhibits non-streaking properties when used in the compositions of the present invention is propylene glycol monomethyl ether, available under the trade designations "Dowanol" PM (from Dow Chemical Company, Midland, Mich.), "Propasol Solvent M" (from Union Carbide Corporation, Danbury, Conn.), and "Arcosolv" PM (from Arco Chemical Company, Philadelphia, Pa.).

Typical, but non-limiting examples are selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereof. Other suitable solvents include acetone, butanone, N-methylpyrrolidone, alkyl ethers of alkylene glycols, alkanolamines, N-alkyl alkanolamines, low molecular weight ketones, and water soluble alkyl pyrrolidones. It is preferred to use an alkylene glycol ether in this invention. The alkylene glycol ether can include ethylene glycol monobutyl ether, ethylene glycol monopropyl ether, propylene glycol n-propyl ether, propylene glycol monobutyl ether, dipropylene glycol methyl ether and mixtures thereof. Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol sold as butyl Carbitol, also by Union Carbide, and propylene glycol n-propyl ether, available from a variety of sources. Another preferred alkylene glycol ether is propylene glycol t-butyl ether, which is commercially sold as Arcosolve PTB, by Arco Chemical Co. The n-butyl ether of propylene glycol is also a preferred additive material.

Suitable wetting agents can be readily identified by those of ordinary skill in the art without undue experimentation. Examples include, but are not limited to, silicone compounds such as silicone copolyols, silicone sulfates, methyl hydrogen silicone emulsions, silicone oil emulsions, silicone carboxylates, silicone esters, and the like. Examples of other wetting agents include, but are not limited to, ethoxylated alcohols, sulfate and sulfosuccinate surfactants, and the like. A preferred wetting agent is an ether ethoxylate; most preferably, 3-(3-Hydroxypropyl)-heptamethyltrisiloxane, ethoxylated, hydroxy-terminated, a silicone glycol copolymer.

Polymeric wetting agents such as fluoropolymers, may also be used. Examples of fluoropolymers include poly (tetrafluoroethylene) (PTFE), ethoxylated fluorocarbons, perfluorooctanyl sulfonate derivatives, and fluorinated polyesters, and the like; however there are environmental considerations for fluorocarbons which may limit the use.

The wetting agent may also contain anionic species contributing to the anti-static properties of polymeric films formed from the liquid compositions. This includes amphoteric and zwitterionic materials, as well as anionic materials, because these materials will also express their negative charge at the polymeric film surface to repel dust, dirt, soil and grime.

Examples of polymeric wetting agents that contribute to anti-static properties include, but are not limited to, zwitterionic polymers, such as, for example, betaines, carboxy betaines, phosphobetaines, sulfobetaines, and glycinates; amphoteric polymers, such as, for example amphoteric fluorocarbons, anionic polymers, such as, for example, anionic silicones, such as fluorosilicone polyesters, fluorosiloxanes and anionic fluorocarbons such as phosphated fluorocarbons, fluoroacrylates, and the like. Examples of other anionic polymer wetting agents include, but are not limited to dioctyl sulfosuccinates, ditridecyl sulfosuccinates, and the like. The amount of wetting agent employed is that quantity effective to reduce the surface tension of the liquid composition below about 25 milli-newtons per meter. If the liquid composition surface tension is below about 25 milli-newtons per meter without the wetting agent, then the quantity employed is optional and is that amount effective to lower the surface tension of the liquid composition. The quantity employed should not be so great as to increase the viscosity of the liquid composition above that which can be used with standard consumer-product packaging such as aerosol and trigger-spray delivery systems, aqueous and non-aqueous gels and saturated wipes. Typically, from about 0.1 to about 2% V. of the wetting agent, in addition to the anti-static polymer employed, will be used. Preferred levels of wetting agent range between about 0.01 to about 1.0% V. Again, the present invention includes all possible ranges within the broadest range defined, beginning with 0.01% V, 20.0% V, 50.0% V, and so forth, and ending with 0.1% V, 2.0% V, and 5.0% V, with ranges incorporating the levels of wetting agent polymer depicted in the Examples.

The wetting agents reduce surface tension, reduce soil water repellency, soil compaction and dust, as well as performance longevity. When wetting agents are applied it causes the liquid to create particles called micelles, as described above, which allow the penetration of the solid by the liquid. Micelles are made up of molecules that attract water and molecules that repel water. In water, the wetting agent causes the micelles to assemble in a large cluster where the water-attracting molecules form a ring with the water-repelling molecules in the center. When the wetting agent is used in oily liquids, the structure of the micelle is reversed as the water-repelling molecules are on the outside of the ring because they are attracted to the oily liquid and the water-attracting molecules are repelled by the oily liquid.

The cleaning formulation may comprise about 0.1% V to about 2.0% V, about 2.0% V to about 6.0% V, about 6.0% V to about 20.0% V, and/or about 30.0% V of the wetting agents. The wetting agents help homogenize the various other component(s) of the cleaning formulations and thus prevent separation. The agent can also facilitate wetting of different surfaces to help remove polar, nonpolar, inorganic, organic, and particulate materials from those surfaces. Additionally, the wetting agent can depress the freezing point of the cleaning formulations so they can be used at lower temperatures.

Suitable wetting agents include glycols for lowering the surface tension of said liquid composition that also contribute anti-static properties to said polymeric film coating.

The environmental impurity resistance mixture comprises a quaternary amine compound, an alkyl siloxane nonionic polyether surfactant, cyclosiloxane and alkyl siloxane.

The cation-active compounds employed are quaternary ammonium compounds derived from lower monoalkyl dialkanolamines. The cation-active compounds include a) dialiphatic, dialkoxylated quaternary ammonium compounds, and b) monoaliphatic, trialkoxylated quaternary ammonium compounds, as described by formulae in U.S. Pat. Nos. 3,123,640 and 3,141,905. These patents describe cation-active surface active chemical compounds.

Examples of dialkyl quaternary compounds (quats) are di($C_8$-$C_{12}$) dialkyl dimethyl ammonium chloride such as didecyldimethylammonium chloride, and dioctyldimethylammonium chloride (BARDAC 2050). Other cationic antimicrobial additives that can be used in the improved cleaning composition include, but are not limited to, diisobutylphenoxyethoxyethyl dimethylbenzyl ammonium chloride, commercially available as Hyamine 1622 from Lonza. Some quats are sold as mixtures of two or more different quats. Examples of these commercially available quat mixtures include, but are not limited to, twin chain blend/alkyl benzyl ammonium chloride compounds available as BARDAC 205M, BARDAC 208M, BARQUAT 4250, and BARQUAT 4250Z from Lonza, Inc.; as BTC 885, BTC 888, BTC 2125M and BTC 2250 from Stepan Chemical Co.; as FMB 504 and FMB 504-8 from Huntington; and as MQ 615M and MQ 624M from Mason.

Some examples of commercially available quaternary amines that can be included in the improved cleaning formulation include, but are not limited to, didecyl dimethyl ammonium chloride, available as BTC 1010 from Stepan Chemical Co.; di($C_6$-$C_{14}$)alkyl di($C_{1-4}$ alkyl and/or hydroxyalkl) quaternary ammonium compounds such as BARDAC 2250 from Lonza, Inc.; FMB 210-15 from Huntington; Maquat 4450-E from Mason; dialkyl dimethyl ammonium chloride available as BTC 818 from Lonza, Inc.; FMB 302 and Maquat 40 from Mason; alkyl dimethyl benzyl ammonium chloride available as BTC 835 and BARQUAT MB-50 from Lonza, Inc.; FMB 451-5 and MC 1412 from Mason, alkyldimethylbenzyl ammonium chlorides such as the commercially available Barquat MB-50 from Lonza; N-(3-chloroallyl) hexaminium chlorides such as Dowicide and Dowicil available from Dow; benzethonium chloride such as Hyamine from Rohm & Haas; methylbenzethonium chloride represented by Hyamine IOX supplied by Rohm & Haas; and/or cetylpyridinium chloride such as Cepacol chloride available from Merrell Labs.

Cationic surfactants are commonly employed as fabric softeners in compositions added during the rinse cycle of clothes washing. Many different types of fabric conditioning agents have been used in rinse cycle added fabric conditioning compositions as disclosed by U.S. Pat. No. 5,236,615, Trinh et al. and U.S. Pat. No. 5,405,542, Trinh et al., both patents herein incorporated by reference in their entirety. The most favored type of agent has been the quaternary ammonium compounds. Many such quaternary ammonium compounds are disclosed for example, by U.S. Pat. No. 5,510,042, Hartman et al. incorporated herein by reference in its entirety. These compounds may take the form of noncyclic quaternary ammonium salts having preferably two long chain alkyl groups attached to the nitrogen atoms. Additionally, imidazolinium salts have been used by themselves or in combination with other agents in the treatment of fabrics as disclosed by U.S. Pat. No. 4,127,489, Pracht, et al., incorporated herein by reference in its entirety. U.S. Pat. No. 2,874,074, Johnson discloses using imidazolinium salts to condition fabrics; and U.S. Pat. No. 3,681,241, Rudy, and U.S. Pat. No. 3,033,704, Sherrill et al. disclose fabric conditioning compositions containing mixtures of imidazolinium salts and other fabric conditioning agents. These patents are incorporated herein by reference in their entirety.

Particularly preferred quaternary amine salts useful in the present invention within the general formula are those in which $R^1$ and $R^2$ are each hydroxyethyl, and $R^3$ is isotridecyloxypropyl. One such quaternary amine salt is that known under the trade designation "Q-17-2" from EXXON Chemical Company, Houston, Tex. wherein $R^1$ and $R^2$ are each hydroxyethyl, and $R^3$ is isotridecyloxypropyl, $R^4$ is methyl, and X is atomic chlorine.

Surfactants that may be used in the present composition include salts of long chain alkyl sulfonic acids, salts of alkyl aromatic sulfonic acids, salts of aromatic alkyl sulfonic acids, alkyl polyoxyethyl phosphate esters, aromatic polyoxyethyl phosphate esters, mixed alkyl aromatic polyoxyethyl phosphate esters, alkylated aromatic polyoxyethylethanols, higher alkyl acetylenic glycols and their polyoxyethylethanols derivatives, salts of alkylsulfosuccinates, polyethylene oxide esters of fatty acids, salts of fatty acid amides of amino sulfonic acids, mono- and di-esters of glycerol and polyglycerols, mono- and di-esters of sorbitol, mono- and di-fatty acid esters of sorbitol, polyoxyethyl sorbitan esters, polyoxyethyl sorbitol esters, salts of alkyl polyoxyethyl ethers of propane sulfonic acid, fatty acid amides of diethanol amine, fatty acid amides of morpholine, polyethoxylated fatty alcohols, polyethoxylated fatty amines, alkyl quaternary amine halides, benzyl alkyl quaternary amine halides, and alkyl aromatic quaternary halides.

The quaternary amine salts useful in the invention as surfactants also preferably reduce the tendency of the formulations of the invention to be low-foaming.

The formulation can also optionally include one or more functional polydimethylsiloxones. For example, in some embodiments, a polyalkylene oxide-modified polydimethylsiloxane, nonionic surfactant or a polybetaine-modified polysiloxane amphoteric surfactant can be employed as an additive. Both, in some embodiments, are linear polysiloxane copolymers to which polyethers or polybetaines have been grafted through a hydrosilation reaction. Some examples of specific siloxane surfactants are known as SILWET™ surfactants available from Union Carbide or ABIL™ polyether or polybetaine polysiloxane copolymers available from Goldschmidt Chemical Corp., and described in U.S. Pat. No. 4,654,161 which patent is incorporated herein by reference.

In some embodiments, the particular siloxanes used can be described as having, e.g., low surface tension, high wetting ability and excellent lubricity. For example, these surfactants are said to be among the few capable of wetting polytetrafluoroethylene surfaces. Certain polysiloxane copolymers in a mixture with hydrocarbon surfactants provide excellent rinse aids on plasticware. The combination of certain silicone polysiloxane copolymers with conventional hydrocarbon surfactants also provide excellent rinse aids.

In some embodiments, the composition may include functional polydimethylsiloxanes in an amount in the range of up to about 20% V. For example, some embodiments may include in the range of about 1 to 20% V of a polyalkylene oxide-modified polydimethylsiloxane or a polybetaine-modified polysiloxane, optionally in combination with about 1 to 20% V of a nonionic surfactant.

When applied to a suitable surface, the present formulation forms a substantially hydrophobic coating of the anionic functionalized siloxane polymer on the treated surface. These polymers effectively deposit on surfaces that have cationic sites, which are capable of forming bonds or linkages with the anionic groups of the polymer. The treated surface becomes hydrophobic due to the deposition of the anionic functionalized siloxane polymer, which then imparts a variety of end use benefits to that surface such as ease of cleaning, soil release, stain removal and prevention, conditioning, etc. The anionic functionalized siloxane polymer further acts to enhance deposition of active agents onto the surface and to improve retention and efficacy of these active agents on the treated surface. The present compositions are useful in a variety of applications including substrate surface cleaning.

Silicone oils including the polyalkylsiloxanes such as polydimethylsiloxanes (PDMS), because of their hydrophobic nature, have been suggested for inclusion for example in cleaning formulations to inhibit the adhesion of particles, debris and other materials. To improve the adherence of the silicone on surfaces, it has been suggested to modify the silicone by addition of functional groups such as carboxy, anhydride, polyol and amino groups. Such modified silicones have been suggested for modifying various surfaces; including fibers, textiles, leather, paper, plastic, wood, metal, glass, stone and concrete. For example, aminoalkyl silicones are described in U.S. Pat. Nos. 5,078,988; 5,154,915; 5,188,822; and 5,427,770, all assigned to Chesebrough-Ponds and in U.S. Pat. Nos. 6,153,567; 6,129,906 and 6,024,891, all assigned to Procter & Gamble. Carboxyl or anhydride group containing silicones are disclosed in U.S. Pat. Nos. 4,501,619; 4,563,347; 4,587,320; 4,944,978; 5,063,044 5,280,019, all assigned to Dow Corning; in U.S. Pat. No. 4,857,212 assigned to Toray Silicone; U.S. Pat. Nos. 4,701,269; 4,931,062; 5,702,490 and 6,007,801, all assigned to BASF; U.S. Pat. No. 4,658,049 assigned to Chisso; U.S. Pat. No. 4,844,888 assigned to Gillette; U.S. Pat. Nos. 5,248,783 and 5,296,625 both assigned to Siltech; U.S. Pat. Nos. 5,015,700 and 5,504,233 assigned to Wacker Chemie; JP Patent Publication No. 04/120014 and U.S. Pat. No. 5,210,251 assigned to Kao; U.S. Pat. No. 4,876,152 assigned to PPG; U.S. Pat. No. 4,342,742 assigned to L'Oreal and U.S. Pat. Nos. 5,536,304 and 5,888,491, both assigned to 3M. Dimethicone copolyols are disclosed in U.S. Pat. Nos. 5,759,523; 5,827,505; 5,856,282; 6,004,538 and 6,129,906 all assigned to Procter & Gamble.

The surfactant which can be used in the cleaning formulation according to the invention is preferably a silicone surfactant which provides an aqueous use solution having a reduced surface tension compared to aqueous use solutions not containing the silicone surfactant. The silicone surfactant preferably includes a polysiloxane hydrophobic group modified with one or more pendent hydrophilic polyalkylene oxide groups. Such silicone surfactants provide a cleaning formulation having low surface tension, high wetting, antifoaming and excellent stain removal. The silicone surfactant can be advantageously used in a cleaning formulation with the primary surfactant for reducing the surface tension of the aqueous solutions. The silicone surfactant can be considered nonionic or ionic (i.e., amphoteric).

Preferred silicone surfactants which can be used according to the invention can be characterized as polydialkyl siloxanes, preferably polydimethyl siloxanes to which hydrophilic group(s), such as polyethylene oxide, have been grafted through a hydrosilation reaction. The process results in an alkyl pendent (AP type) copolymer, in which the hydrophilic groups are attached along the siloxane backbone through a series of hydrolytically stable Si—C bond. The modified polydialkyl siloxane surfactants can have the following generic formulae:

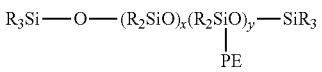

wherein PE represents a nonionic group, preferably $—CH_2—(CH_2)_p—O-(EO)_m(PO)_n—Z$, EO representing ethylene oxide, PO representing propylene oxide, x is a number that ranges from about 0 to about 100, y is a number that ranges from about 1 to 100, m, n and p are numbers that range from about 0 to about 50, m+n< or =1 and Z represents hydrogen or R wherein each R independently represents a lower ($C_{1-6}$) straight or branched alkyl. Preferably, p is a number from 0 to 10, and R is methyl; $R_2$ or $R_3$ is an alkyl $C_{1-6}$.

Preferred silicone surfactants are sold under the SILWET™ or under the ABIL™ B trademark or Xiameter OFX 5211 trademark. One preferred silicone surfactant, SILWET™ L77, has the formula:

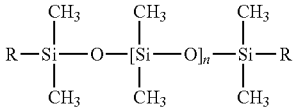

wherein $R^1$ is $—CH_2CH_2CH_2—O—(CH_2CH_2O)_zCH_3$ and wherein z is 4 to 16 preferably 4 to 12, most preferably 7 to 9.

Another class of silicone surfactants is an end-blocked (AEB type). Preferred AEB type silicone surfactants have the following general formula:

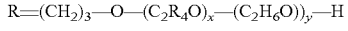

wherein x represents 0 to 100, y represents 1 to 100, x+y represent 1 to 200. A preferred AEB type silicone surfactant is available under the name ABIL™.

The surfactant can be provided in the environmental impurity resistance formulation of the invention in an amount of from about 0.01% V to about 20.0% V. Preferably, the surfactant is provided in an amount of between about 0.05% V and about 5.0% V, and more preferably in an amount of between about 0.1% V and about 1.0% V.

The environmental impurity resistance mixture comprises of: 10.0% V of quaternary amine compound, more preferably, 1.0% V; most preferably, 0.5% V; 10.0% V of a second quaternary amine compound, more preferably, 1.0% V; most preferably, 0.5% V; 10.0.0% V of a third quaternary amine compound, more preferably, 1.0% V; most preferably, 0.3% V; 10.0% V of a fourth quaternary amine compound, more preferably, 1.0% V; most preferably, 0.1% V; 2.0% V. of an alkyl siloxane nonionic polyether surfactant, more preferably, 0.5% V; most preferably, 0.2% V; 2.0% V of cyclosiloxane; more preferably, 0.5% V; most preferably, 0.25% V; and 5.0% V of alkyl siloxane, more preferably, 0.5% V; most preferably, 0.25% V.

The environmental impurity resistance mixture employs a quaternary amine compound, more preferably, quaternary ammonium compounds, most preferably, ethyldimethyl soya alkyl ethyl sulfate; a second quaternary amine compound, more preferably, Fatty acids, coco reaction products with diethylenetriamine and soya fatty acids, ethoxylated, chloromethane quaternized; most preferably, coco alkyltrimethyl, chlorides; an alkyl siloxane nonionic polyether surfactant, more preferably, Decamethylcyclopentasiloxane; most preferably, a mixture of Octamethylcyclotetrasiloxane and Decamethylcyclopentasiloxane and an alkyl siloxane, more preferably, 3-(3-Hydroxypropyl)-heptamethyltrisiloxane, ethoxylated, Hydroxy-terminated.

The pH of the formulation should be 7.0, and preferably from about 7.0 to about 9.0. The most preferred pH range is about 8.0 to about 8.5. If necessary for pH adjustment, certain buffers, alkali, acids, etc., are used which are well known to those skilled in the art. Optional pH adjusting agents can include, but are not limited to citric acid, succinic acid, phosphoric acid, sodium hydroxide, sodium carbonate, and the like. It has been found that raising the pH above about 8.0 has a beneficial effect upon the grease cleaning capability of the surfactants used in the present invention, and while lower pH may be acceptable for light duty cleaning where little or no greasy soil is present, such as with a glass cleaner, elevation of the pH to a value of from about 8.0 to about 8.5 is preferred. Above a pH of about 9.0, however, the cleaning formulation becomes excessively caustic, presenting possible damage to surfaces upon which the formulation is used. Moreover, such highly caustic solutions create an unstable system, and can be damaging to processing, handling, and storage equipment.

The practice of the invention is further described by the following illustrations where the proportions of the ingredients of the cleaning formulation are expressed in weight basis.

EXAMPLES

The following examples describe some of the preferred embodiments of the present technology without limiting the technology thereto. Other embodiments include, but are not limited to, those described in the above written description, including additional or alternative components, alternative concentrations, and additional or alternative properties and uses.

Examples 1-3

| Component | Example 1 Formulation % V | Example 2 Formulation % V | Example 3 Formulation % V |
|---|---|---|---|
| Cleaning Formulation | 0.001-10.0 | 0.1-4.0 | 0.02-4.0 |
| Primary Surfactant 1 Mixture) Alcohols-$C_9$-$C_{11}$ Ethoxylated Alcohols-$C_{10}$-$C_{16}$ Ethoxylated | | | |
| Primary Surfactant 2 Polyoxyethylene ($C_{13}$) Ether (Ethoxylate) | 0.01-10.0 | 0.02-5.0 | 0.03-1.0 |
| Co-surfactant Dipropylene Glycol n-Propyl Ether | 0.1-10.0 | 0.2-5.0 | 0.03-1.0 |
| Secondary Surfactant | 0.001-10.0 | 0.2-5.0 | 0.03-1.0 |

-continued

| Component | Example 1 Formulation % V | Example 2 Formulation % V | Example 3 Formulation % V |
|---|---|---|---|
| Ethanol, 2-2'-iminobis-,n-[3-(branched decyloxy)propyl)] derivs, N-oxides 2-propanol | | | |
| Secondary Surfactant Secondary alcohol ethoxylate | 0.01-10.0 | 0.02-5.0 | 0.03-1.0 |
| Citrus based solvent Citrus terpenes | 0.001-7.0 | 0.01-2.0 | 0.03-1.0 |
| Nonionic surfactant | | | |
| Environmental Impurity Resistance Mixture | | | |
| Cationic Compound 1 coco alkylbis(hydroxyethyl) methyl, ethoxylated, chlorides | 0.1-5.0 | 0.1-5.0 | 0.1-5.0 |
| Cationic Compound 2 ethyldimethylsoya alkyl ethyl sulfate | 0.1-5.0 | 0.1-5.0 | 0.1-5.0 |
| Cationic Compound 3 Emulsifier, Fatty acids, coco, reaction products and diethylenetriamine and soya fatty acids, ethoxylated, chloromethane-quaternized | 0.1-5.0 | 0.1-5.0 | 0.1-1.0 |
| Cationic Compound 4 Quaternary Ammonium Compounds | 0.1-10.0 | 0.1-5.0 | 0.1-1.0 |
| Sodium Lauroyl Sarcoscinate | 0.01-10.0 | 0.02-5.0 | 0.03-1.0 |
| Siloxane Polyether Surfactant 3-(3-Hydroxypropyl) - heptamethyltrisiloxane, ethoxylated, Hydroxy-terminated | 0.01-10.0 | 0.02-5.0 | 0.03-1.0 |
| Alkylcyclosiloxane Decamethylcyclopentasiloxane | 0.01-10 | 0.1-5.0 | 0.1-1.0 |
| Buffer 25% ammonia hydroxide | 0.0-1.0 | 0.0-1.0 | 0.0-1.0 |

Application Procedure

| Item | Invention Formulation | Comparative Sample 1 | Comparative Sample 2 |
|---|---|---|---|
| 1. % Cleaning and Removal performance | Effective | Effective | Effective |
| 2. Smear or Lace Curtain Effect | No | Yes | Yes |
| 3. Streak test | None observed | None observed | None observed |
| 4. Surface effect | Water resistance Dirt sheds from surface; Example 3 best performance | Water resistance Dirt sheds from surface Better than Example 1 | Water resistance Dirt sheds from surface Better than Example 1 Equal to Example 2 |
| 5. Foreign Substance (Dirt) Re-deposit Resistance | Yes | No | No |

The cleaning formulation was applied in a variety of dilute concentrations in water sprayed on glass surface. Two glass cleaning formulations such as 3% ammonia solution and a mixture of ethanol and coconut based cleaning agent (non-ionic surfactant: alkylpolyglucoside) were used on two other glass surfaces.

During the 14 day period, it was observed that utilizing the Cleaning and Environmental Impurity Resistance Mixture Formulation of the present invention provided a sparkling substrate and was maintained throughout the period. It was particularly noted that morning dew and water accumulating on the glass surfaces or during a light rain, there was no trace of smear or lace curtain effect or any vision obstruction. On the other hand, two comparative cleaning formulations effectively cleaned the glass surfaces but produced smear or lace curtain effect and provided no water and dirt re-deposit resistance.

The foregoing examples and description of the preferred embodiment should be taken as illustrating, rather than as limiting, the present invention as defined by the claims. As would be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

What is claimed is:

1. A cleaning formulation having improved residue removal capability and substantially reduced filming or streaking, said formulation comprising of:

(a) an effective amount of citrus based compounds and mixtures thereof; said citrus based compound is selected from the group consisting of citrus terpenes, d-limonene, and a mixture of terpenes and citrus-derived non-ionic surfactants;

(b) an effective amount of a surfactant selected from primary nonionic surfactants, secondary nonionic surfactants, co-surfactants and mixtures thereof; said primary nonionic surfactant has a structure I:

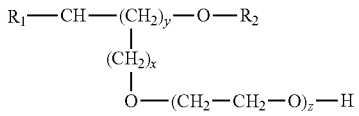

wherein $R_1$ is an aliphatic hydrocarbon radical with 4 to 18 carbon atoms, $R_2$ is an aliphatic hydrocarbon radical with 1 to 10 carbon atoms, x and y are integers 0 and 1, z is a value greater than 1, the sum of the carbon atoms of $R_1$ and $R_2$ is from 8 to 26 and the sum of x+y is 1;

said secondary nonionic surfactant is selected from amine oxide having the general structure:

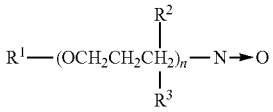

wherein $R^1$ is selected from alkyl group having between 8 and 12 carbon atoms n has a value of 1 or 2; $R^2$ and $R^3$ are at least one alkoxylate unit;

said co-surfactant is selected from the group consisting of glycol ether surfactant, polyether polyols, glycol butyl ethers, glycol propyl ethers, or ether amine oxides;

(c) an effective amount of a wetting agent; and (d) an effective amount of a cleaning and environmental impurity resistance mixture having improved properties, improved dirt and water resistance and substantially reduced surface deposits, said mixture comprising: i) an effective amount of one to four quaternary ammonium compounds selected from the group consisting of soy, coconut, and palm derived compounds and mixtures thereof; ii) an effective amount of anionic surfactant salts of condensation products of fatty acids with sarcosine; iii) an effective amount of alkyl and cyclic siloxanes; and iv) a buffer solution comprising an alkyl hydroxide or organic amine selected from alkyl or ammonia;

said environmental impurity resistance mixture further comprising additional quaternary ammonium compounds; an alkyl siloxane nonionic polyether surfactant and a mixture of cyclosiloxane and polydimethylsiloxane; said alkyl siloxane nonionic polyether surfactant is selected from the group consisting of silicone polyether (glycol) copolymers and silicone poly (ethylene oxide or propylene oxide) monoallyl ether acetate; said cyclosiloxane selected from the group consisting of octamethylcyclotetrasiloxane, decamethylcyclopentasiloxane, and mixtures thereof.

2. The cleaning formulation according to claim 1 wherein the said effective amount of citrus based compound is about 0.001% V to about 7% V.

3. The cleaning formulation according to claim 1 wherein the primary nonionic surfactant is selected from the group consisting of primary and secondary alcohol ethoxylates, ethoxylated alcohols $C_8$-$C_{16}$, ethoxylated secondary alcohols $C_{12}$-$C_{14}$, and a mixture of ethoxylated alcohols $C_9$-$C_{11}$ and ethoxylated alcohols $C_{10}$-$C_{16}$.

4. The cleaning formulation according to claim 1 wherein the effective amount of primary nonionic surfactant is about 0.001% V to about 10% V.

5. The cleaning formulation according to claim 1 wherein the effective amount of secondary nonionic surfactant is about 0.01% V to about 10% V.

6. The cleaning formulation according to claim 1 wherein the effective amount of the co-surfactant is about 0.01% V to about 10% V.

7. The cleaning formulation according to claim 1 wherein the quaternary ammonium compounds have the structural formula:

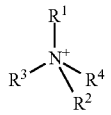

wherein $R^1$ and $R^2$ may be the same or different and are selected from the group consisting of methyl, ethyl, propyl, isopropyl, hydroxyethyl, and hydroxypropyl; $R^1$, $R^2$ and $R^3$ are a straight or branched alkyl or heteroalkyl moiety having from about 10 to 20 carbon atoms, and optionally comprising alkyl ethers having from about 10 to 20 carbon atoms; and $R^4$ is selected from the group consisting of alkyl groups having from 1 to about 5 carbon atoms.

8. The cleaning formulation according to claim 1, comprising:

a) approximately about 0.1 to 2.0% V of citrus based compounds and mixtures thereof;

b) approximately about 0.1 to 4.0% V of the surfactant selected from the group consisting of primary and secondary non-ionic surfactants, co-surfactants and mixtures thereof;

c) approximately about 0.1 to 2.0% V of the wetting agent; and e) approximately about 0.1% V to 10.0% V of the environmental impurity resistance mixture.

9. The cleaning formulation according to claim 1 further comprising:

an effective amount of an emulsifier selected from the group consisting of dialkyl quaternary amines, ether amine oxides, ethoxylated quaternary compounds, polyoxyethylene alkylamine quaternary, and mixtures thereof.

10. A method of cleaning soil, without substantial residue remaining, comprising:

1) Contacting a soiled substrate surface with the cleaning formulation of claim 1

2) Removing and rinsing said soil and said cleaning formulation from said surface.

11. The method according to claim 10 wherein the substrate is selected from the group consisting of solar panels, glass composites, fiberglass, polymer, glass, rubber, coated surfaces, steel, aluminum, plastics materials, composites, thermoplastic polymer fabrics, thermoplastic polymer fibers, and metal composites.

12. The cleaning formulation according to claim 1, wherein the non-ionic surfactants have an HLB greater than 11.

13. The cleaning formulation according to claim 1, wherein the wetting agents are selected from the group consisting of silicone copolyols, silicone sulfates, methyl hydrogen silicone emulsions, silicone oil emulsions, silicone carboxylates, silicone esters, ethoxylated alcohols, sulfate and sulfosuccinate surfactants, ether ethoxylate; and silicone glycol copolymer.

14. The cleaning formulation according to claim 13 wherein the secondary nonionic surfactant is present in an amount of about 0.001% to about 10.0% V.

* * * * *